United States Patent [19]

Chuing-Hui

[11] Patent Number: 4,998,193

[45] Date of Patent: Mar. 5, 1991

[54] FLOOR LAMP STRUCTURE WITH A DETACHABLE SHADE

[76] Inventor: LeeYeh Chuing-Hui, P.O. Box 96-405, Taipei, 10098, Taiwan

[21] Appl. No.: 516,339

[22] Filed: Apr. 30, 1990

[51] Int. Cl.[5] ..... F21S 1/12

[52] U.S. Cl. ..... 362/414; 362/353

[58] Field of Search ..... 362/351, 353, 361, 410, 362/414, 439

[56] References Cited

U.S. PATENT DOCUMENTS

| | | | |
|---|---|---|---|
| 1,310,228 | 7/1919 | Woodhead | 362/353 X |
| 1,544,941 | 7/1925 | Scherer | 362/353 |
| 1,840,740 | 1/1932 | Ramsey | 362/410 X |
| 2,048,313 | 7/1936 | Adolfson | 362/414 X |
| 2,521,448 | 9/1950 | Corcoran | 362/414 X |
| 2,731,547 | 1/1956 | Callard | 362/414 |

*Primary Examiner*—Stephen F. Husar
*Assistant Examiner*—Peggy A. Neils

[57] ABSTRACT

A floor lamp structure with a detachable shade and mainly comprises a supporting rod, a supporting stem, a trumpet-shaped member, a blub socket, a lamp shade and a retaining collar. The trumpet-shaped member is mounted on the lower end of the supporting stem while the bulb socket is mounted on the upper end of the supporting stem. The shade is mounted on the upper end of the bulb socket and is fixed in a threaded portion of the socket with a retaining collar. The lamp shade may be designed into various shapes, and is made of an opaque or transparent material. The lamp shade of the present invention can be mounted or dismounted easily and quickly.

1 Claim, 2 Drawing Sheets

FLOOR LAMP STRUCTURE WITH A DETACHABLE SHADE

BACKGROUND OF THE INVENTION

1. Field of the Invention

This invention relates to a floor lamp, and particularly to a floor lamp structure with a detachable lamp shade. The lamp shade ma be designed into various shapes for decoration purpose.

2. Description of the Prior Arts

In the conventional floor lamps, the upper end of the supporting rod is mounted with a lamp shade base, on which a shade is fixedly mounted; a threaded rod is mounted with a bulb socket on the upper end thereof, and is mounted in the upper center part of the shade. The shade is usually made of a transparent or opaque material. The switch of the lamp is installed at a suitable point on the power wire, or on the supporting rod.

As a result of the structure and the installing position of such lamp, the shade and the supporting rod are rather difficult to separate each other upon being fixedly assembled together in case of the shade being necessary to replace; otherwise, the bulb socket has to be dismounted completely, and in that case, the safety and tightness of the power wire will be jeopardized.

There is another type cf conventional floor lamp, in which the upper end of the supporting rod is mounted with a lamp shade made of metal. A bulb socket with a switch is installed with a threaded tube in the center of the lamp shade; however, the aforesaid lamp can only have the light thrown upwards without providing a mild downward illumination. In case of the lamp shade being replaced, the bulb socket has to be disassembled, and therefore it is deemed a cumbersome structure.

There is still another type of floor lamp, in which the bulb socket has a threaded part for mounting a lamp shade. The lamp shade is usually designed into a conic shape, which is supported in place with a metal frame and a large ring, and then the metal frame is mounted on the socket, and is fixed in place with a nut. The shade of this type of lamp can be replaced easily; however, it has little or no variety as a result of the cone-shaped shade and the heat dissipation drawbacks. The light of the lamp ca only be thrown downwards without change.

SUMMARY OF THE INVENTION

In view of the drawbacks of the prior art, the inventor has, through repeated studies, developed a floor lamp with a detachable shade; the lamp mainly comprises a supporting rod, of which the upper end is mounted with a fixed trumpet-shaped member, and inside the member, a bulb socket is installed; the external surface of the bulb socket has threads for mounting the shade. The outer rim of the lower part of the shade is in close contact with the trumpet-shaped member; then, the shade is simply fixed in place with a retaining collar, and the shade can be detached or replaced quickly and easily.

The prime object of the present invention is to provide a floor lamp, of which the shade can be mounted on the bulb socket with a retaining collar so as to have the shade dismounted simply for replacement.

Another object of the present invention is to provide a floor lamp, in which the lower external rim of the shade is in close contact with the inner surface of the trumpet-shaped member without affecting the vertical position of the shade and the heat dissipation function.

Still another object of the present invention is to provide a floor lamp, in which the shade can be mounted on the supporting stem with a retaining collar; the shade can be designed into various suitable shapes for decoration purpose, and the shade may be made of an opaque or transparent material.

A further object of the present invention is to provide a floor lamp, in which the switch of the bulb socket extends out of the trumpet-shaped member to make the assembling operation of the lamp much simply than the conventional floor lamps.

DESCRIPTION OF THE PREFERRED EMBODIMENT

Figure 1:
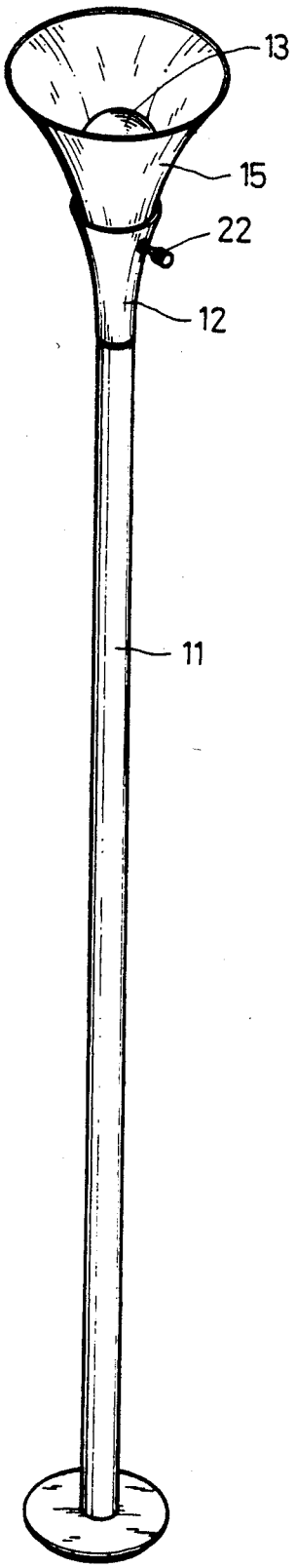
FIG. 1 is a perspective view of an embodiment according to the present invention.
Figure 3:
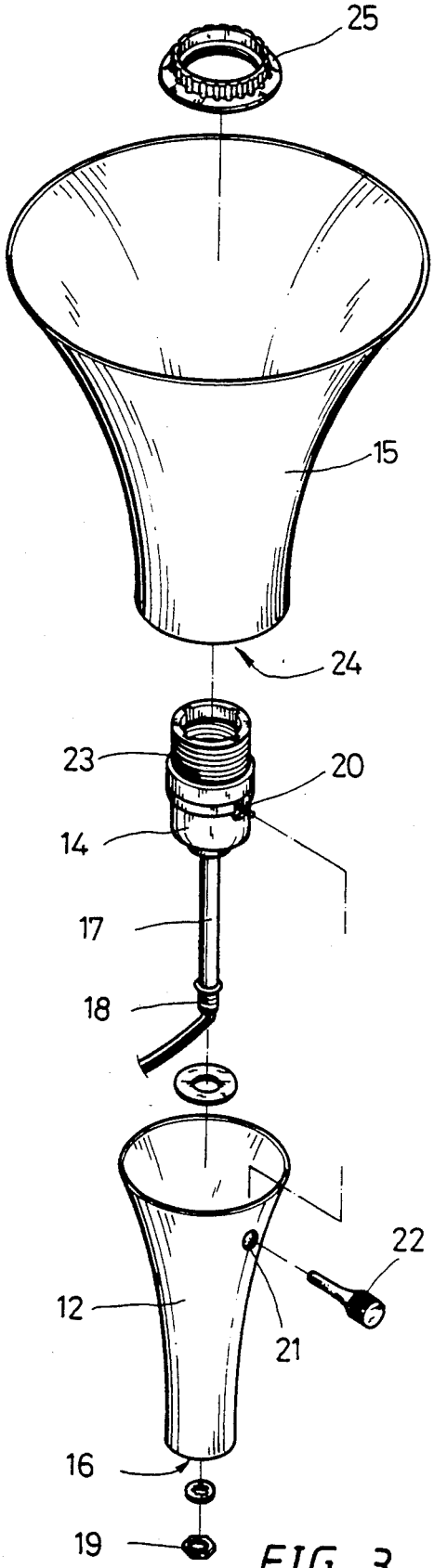
FIG. 3 is a disassembled view of the present invention.
Figure 4:
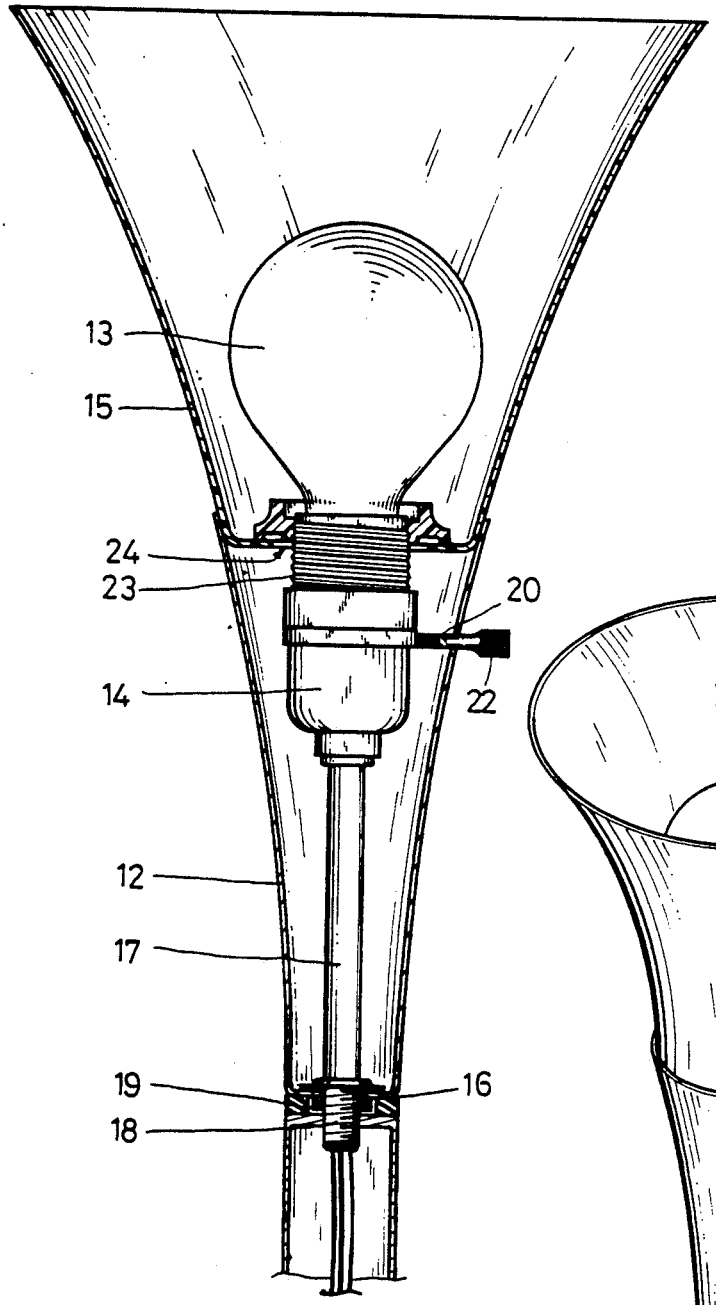
FIG. 4 is a sectional view of the present invention.
Figure 2:
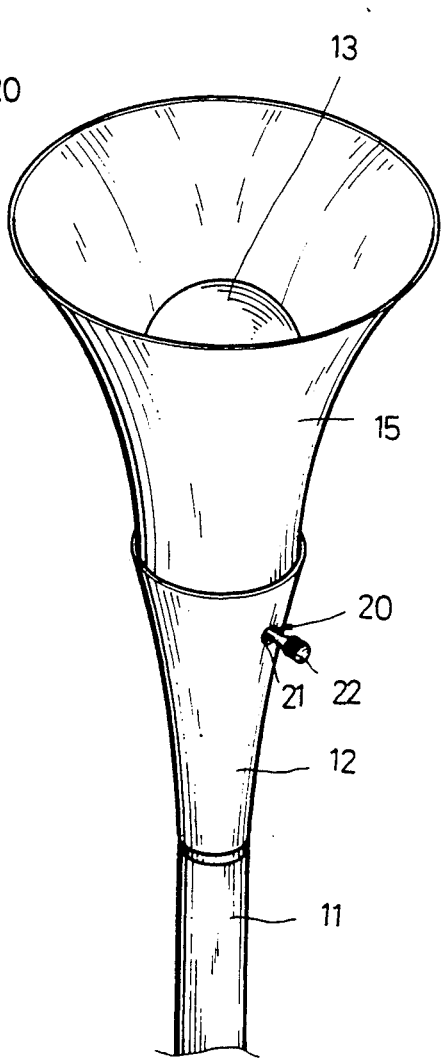
FIG. 2 is a fragmental perspective view of FIG. 1.

It is a floor lamp with a detachable lamp shade as shown in FIGS. 1 to 4. The present invention mainly comprises a supporting rod 11 being mounted with a trumpet-shaped member 12, in which a bulb socket 14 is mounted for fixing a bulb 13, and a lamp shade 15. After the lamp shade is mounted in place, the lamp can provide a suitable illumination function.

The lower end of the trumpet-shaped member 12 has a round hole 16, through which the trumpet-shaped member 12 can be fixedly mounted around the threaded part 18 of the supporting stem 17 by means of a nut 19. The threaded part 18 is also used for connecting with the supporting rod 11 to support the whole lamp.

The upper end of the supporting stem 17 is attached with a bulb socket 14 having a switch knob 20 with an arm 22 to extend out of the trumpet-shaped member 12 through a round hole 21. The bulb socket 14 is first mounted on the upper end of the supporting stem 17 at the same level as the upper end of the trumpet-shaped member 12. The upper end of the bulb socket 14 has an external threaded portion 23 for mounting the lamp shade 15 through a round hole 24 of the lamp shade 15 by means of a retaining collar 25; then, the lower outer surface of the lamp shade 15 can be closely in contact with the inner surface of the trumpet-shaped member 12.

The lamp shade 15 is made of an opaque or transparent material; the lamp shade 15 can provide a function of having most of the lamp light thrown upwards and a part of the lamp light thrown out of the lamp shade horizontally in a mild manner Moreover, the lamp shade according to the present invention may, according to actual requirement, be made in various forms for decoration purpose; the lamp shade can easily be mounted on the socket or dismounted therefrom so as to let the lamp have considerable variety features; therefore, the present invention has the features of novelty and practicality.

I claim:

1. A floor lamp structure with a detachable shade comprising: a supporting rod, a supporting stem having an upper end and a lower end, a trumpet-shaped member, a bulb socket with a switch knob, and a retaining collar; wherein said supporting rod is threaded in the lower end of said supporting stem, said trumpet-shaped member is also fixedly mounted at the lower end of said supporting stem and encloses said bulb socket which is secured to the upper end of said supporting stem, said bulb socket having threads at an external upper end whereby said lamp shade can be mounted there around, said lamp shade being secured in place by said retaining collar screwed on to said bulb socket, and said lamp shade being made of an opaque or transparent material.

* * * * *